US006035457A

United States Patent [19]

Krause, Jr.

[11] Patent Number: 6,035,457

[45] Date of Patent: Mar. 14, 2000

[54] TOILET TANK FLUSH HANDLE

[75] Inventor: Richard L. Krause, Jr., 708 53rd Ave. West, Bradenton, Fla. 34207

[73] Assignee: Richard L. Krause, Jr., Bradenton, Fla.

[21] Appl. No.: 08/959,593

[22] Filed: Oct. 29, 1997

[51] Int. Cl.[7] ..... E03D 5/00

[52] U.S. Cl. ..... 4/405; 4/249

[58] Field of Search ..... 4/249, 405, 412

[56] References Cited

U.S. PATENT DOCUMENTS

| | | | |
|---|---|---|---|
| 718,971 | 1/1903 | Becker | 4/249 X |
| 1,757,159 | 5/1930 | Bardsley | 4/412 |
| 2,204,867 | 6/1940 | Rehback | 4/249 |
| 2,605,479 | 8/1952 | Ansorge | 4/249 |
| 3,032,778 | 5/1962 | Magos et al. | 4/249 |
| 3,925,832 | 12/1975 | Falzone | 4/249 |
| 4,979,238 | 12/1990 | Clark | 4/249 X |
| 5,170,513 | 12/1992 | Ambooken | 4/249 |

*Primary Examiner*—Robert M. Fetsuga

[57] ABSTRACT

An improved hand-actuated toilet tank flush handle assembly with an essentially counterweighted flush actuator rod for use by a physically challenged person in flushing a bowl mounted water storage tank of a toilet assembly. The flush handle is substantially longer, broader in width and larger in hand pressable surface area than those features of a standard or traditional bowl mounted tank type flush handle to better facilitate its use by a person with a hand, arm or torso impairment or weakness. The counterweighted flush actuator rod insures a proper return to its original position and consistent operation. This invention is fully interchangeable with the traditional bowl mounted tank type flush handle.

1 Claim, 1 Drawing Sheet

TOILET TANK FLUSH HANDLE

BACKGROUND OF THE INVENTION

1. Scope of Invention

This invention relates generally to bowl mounted water storage tank type toilet assemblies, and more particularly to an enlarged toilet flushing handle with an essentially counterweighted flushing rod adapted to facilitate toilet flushing by a physically challenged person.

2. Prior Art

Traditional bowl mounted tank type toilet assemblies include a pivotally mounted flushing handle mounted to a front upright side wall of a water storage tank. Flushing is effected by limited pivotal movement of the flushing handle by manual hand pressure. A typical flushing handle has an overall length of about 3" which presents a somewhat flat surface defined by about 1 ½" of handle length and a handle width of about ⅝" for receiving downward hand pressure to effect toilet flushing. However, for a physically challenged person who may have low manual dexterity, weakened hand or arm function, or other hand limiting impairments such as arthritis, this relatively small handle portion area of about one square inch to effect toilet flushing is extremely limiting.

One device known to applicant for addressing this problem is disclosed in U.S. Pat. No. 4,979,238 invented by Clark. This combination toilet seat lifter and toilet flusher is removable to be carried by the user and in one form of use, will slidably engage over the conventional flushing handle to axially extend the length thereof for torque multiplication. However, it is submitted that a person able to use this device as described probably really is not in significant need thereof as the manual dexterity required to hold, position and exert sufficient force so as to temporarily engage this device over the flushing handle will also enable such a person to pivotally actuate the conventional flushing handle itself.

The following patented devices are also known to applicant, but require foot actuation in lieu of manual hand actuation to effect toilet flushing and many physically challenged people are likewise unable to effect this motion due to paralysis or the lack of sufficient control of leg and foot muscles to do so.

| | |
|---|---|
| U.S. Pat. No. 718,971 | Becker |
| U.S. Pat. No. 2,204,867 | Rehback |
| U.S. Pat. No. 5,170,513 | Ambooken, et al. |

The present invention provides an improved hand actuated toilet tank flush handle assembly for facilitating toilet flushing by the physically challenged user. The device, which is completely interchangeable with traditional bowl mounted tank type flushing handles, provides a handle portion which is significantly longer, wider and larger in useable surface area over traditional flushing handles. It also provides an essentially counterweighted flushing rod to insure consistent operation. Thus, the physically challenged user may either effect toilet flushing by exerting downward hand pressure in a broad number of hand positions, depending upon the extent of the disability, all of which may be exerted against the larger contact surface provided without concern for slippage or lack of strength (leverage) to effect toilet flushing.

BRIEF SUMMARY OF THE INVENTION

This invention is directed to an improved hand-actuated toilet tank flush handle assembly for use by a physically challenged person in flushing a bowl mounted water storage tank of a toilet assembly. The flush handle is substantially longer, broader in width and larger in hand pressable surface area than those features of a standard or traditional bowl mounted tank type flush handle to better facilitate its use by a person with hand, arm or torso impairment or weakness. The flushing rod is also essentially counterweighted to counteract the additional weight and length of the handle and insure consistent operation. The invention is fully interchangeable with these traditional flush handles.

It is therefore an object of this invention to provide a handle actuated toilet tank flushing handle assembly which will facilitate toilet flushing by a physically challenged person. Also one that will perform consistently by use of a counterweighted flushing rod.

It is another object of this invention to provide a toilet flushing handle assembly which is interchangeable with a traditional toilet flushing handle and which greatly facilitates toilet flushing by a user with a physically impaired or weakened hand or arm function.

In accordance with these and other objects which will become apparent hereinafter, the instant invention will now be described with reference to the accompanying drawings.

DETAILED DESCRIPTION OF THE INVENTION

Figure 1:
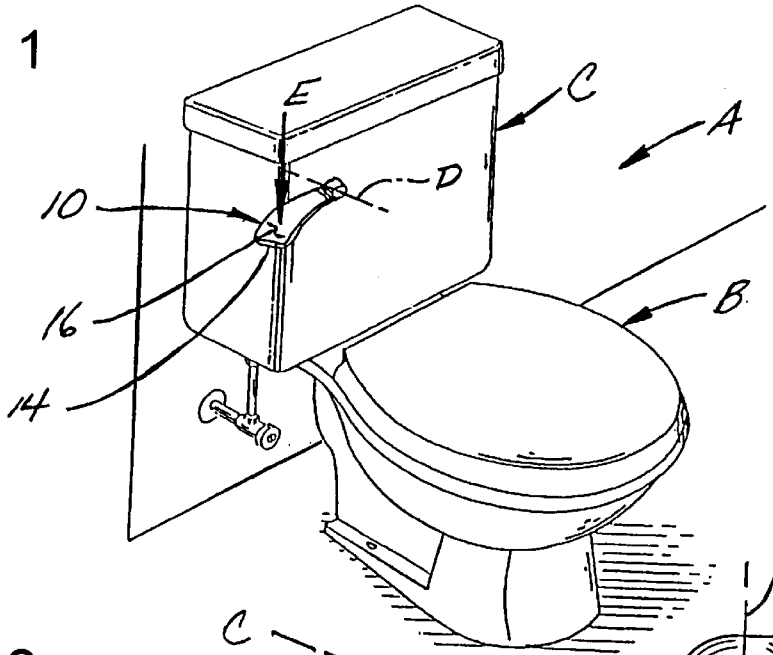
FIG. 1 is a perspective view of a traditional bowl mounted tank type toilet assembly with the invention (10) provided in lieu of a traditional flushing handle.

Referring now to the drawings, the invention is shown generally at numeral 10 in its operative, installed position on a front side wall of a bowl mounted water storage tank C of a toilet assembly A. The toilet assembly A also includes a floor mounted bowl B. To effect toilet flushing, the hand pressable surface 16 of the handle portion 14 is downwardly depressed in the direction of arrow E to effect pivotal rotation of the flushing handle 10 about axis D. As noted in FIG. 3, the counterweighted 24 actuator rod 22 then drops downward to return the handle 16 to its original position.

Figure 2:
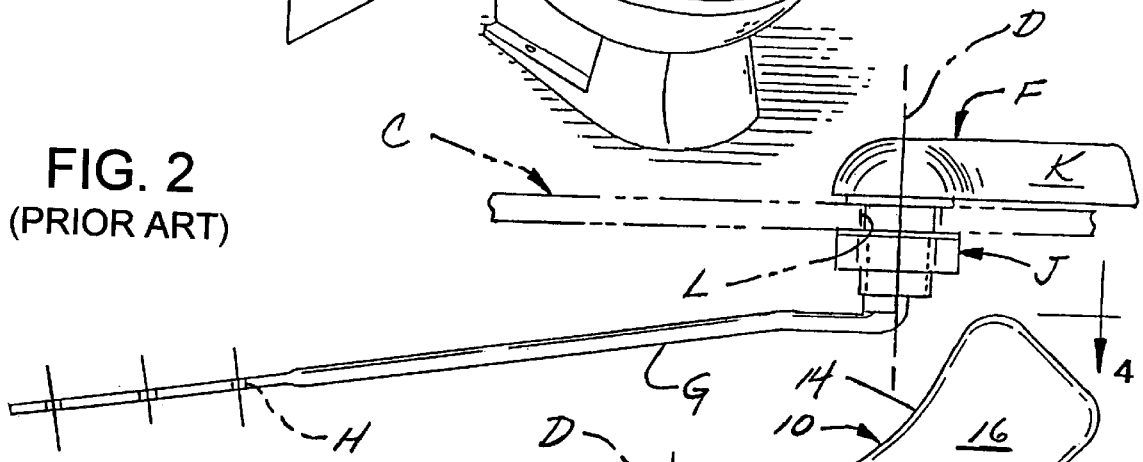
FIG. 2 (PRIOR ART)
FIG. 2 is a top plan broken view partially in phantom of a traditional bowl mounted tank type toilet flushing handle operably connected to a flushing actuator rod positioned on the interior of a water storage tank (C).

Specifically in FIG. 2, the prior art arrangement is there shown as is pertains to the present invention. A traditional flushing handle F is mounted for limited pivotal action only about axis D through an aperture L formed into the upright wall surface of water tank C. A well-known nylon threaded fastener arrangement J both retains the traditional flushing handle F in the position shown for limited pivotal movement only about axis D and effects supportive connection of one end of a flushing actuator rod G includes a plurality of holes H, one of which is selected to receive one end of a flexible chain or linkage which lifts the seating flapper or ball at the bottom of the water tank to release a quantity of water therein when the hand pressable surface K is downwardly depressed.

Figure 3:
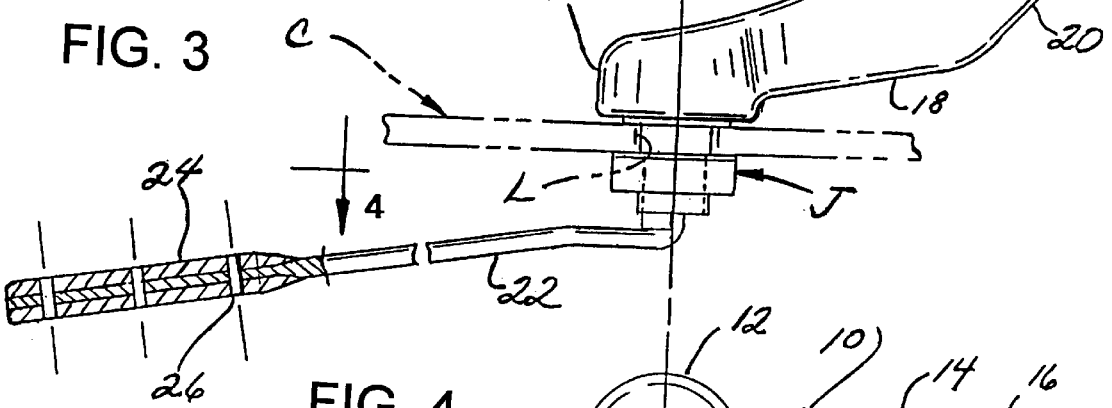
FIG. 3 is a view similar to FIG. 2 except showing the preferred embodiment of the present invention (10) in lieu of the traditional flushing handle and flushing actuator rod.
Figure 4:
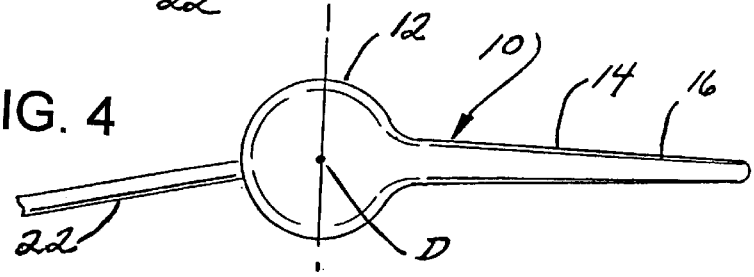
FIG. 4 is a view in the direction of arrows 4—4 in FIG. 3.

The present invention 10 as shown in FIGS. 1, 3, and 4, is fully interchangeable with the traditional arrangement of FIG. 2. The flushing handle 10 is mounted for limited pivotal movement in the upright side wall of water tank C by nylon threaded connector J in aperture L which is also supportively connected to one end of an improved flushing actuator rod 22 with a counterbalanced weight 24 on the distal portion of the rod 22. The handle 10 includes a central hub 12 and a handle portion 14 which presents a substantially enlarged hand pressable surface 16 which is defined along one margin by edges 18 and 20, each of which is further leveraged from pivotal axis D than that of a traditional flushing handle F. To essentially balance the combination of flushing handle 10 and actuator rod 22 about pivotal axis D, a counterweight 24 is added to the distal portion of actuator rod 22. A plurality of spaced apertures 26, one of which is connectable to a flexible chain or linkage (not shown) for interconnection to the tank sealing member (not shown) are also provided.

Size Comparison

To demonstrate the way that the present invention 10 greatly facilitates toilet flushing by a physically challenged person, a dimensional comparison is useful. First, compare the overall available hand pressable surface area K of the traditional bowl mounted tank type handle versus that (16) of the present invention 10. As previously described, the dimensions of this area for a traditional bowl mounted tank type flushing handle is about one square inch, whereas the corresponding surface area for the present invention is about 4 ⅓ sq. in. This demonstrates a surface area ratio between the respective useable hand contact areas of atleast 4:1 in comparing the present invention to the traditional flushing handle.

In comparing overall lengths between the flushing handles as reflective of available mechanical advantage for toilet flushing, the traditional flushing handle typically has a handle length from the pivotal center line D of about 2 ¼", whereas the present invention is dimensioned correspondingly at about 4", producing a length comparison ratio of approximately 1.8:1.

An additional important dimensional comparison is made between the distance of the front margins of handle portions K and 16 furthest from the water tank wall surface. For the traditional flushing handle, this distance is about 0.7 inches, whereas the corresponding width of the present invention is about 3.1" producing a width comparison ratio of about 4.4:1.

As can now be more clearly seen, the present invention provides a toilet flushing handle which greatly facilitates its use by a physically challenged person with some form of hand, arm or torso weakness or impairment which makes depressing a traditional bowl mounted tank type flushing handle difficult. By increasing all the dimensions of handle length, handle width, and effective hand pressable surface area over those factors of a traditional flushing handle, the present invention, when installed into an exsisting aperture of the water tank C of a traditional toilet assembly A, the final flushing action required is made substantially easier for the physically challenged user. The counterweighted flushing actuator rod 24 insures consistent handle operation.

While the instant invention has been shown an described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A method of converting a toilet water tank for facilitating use by a physically challenged person, the tank including a movable flush valve therein and an actuator rod mounted thereto, the actuator rod including a first end attached to the flush valve and a second end having a handle mounted thereto, the actuator rod being pivotable between a rest position wherein the flush valve is seated for retaining water in the tank, and a flush position wherein the flush valve is unseated, the actuator rod being biased to return to the rest position from the flush position when the tank is substantially emptied of water, the method comprising:

removing the handle from the actuator rod;

mounting an enlarged handle to the second end of the actuator rod, the enlarged handle being sized to overcome the bias of the actuator rod to return to the rest position; and mounting a counterbalance weight to the first end of the actuator rod to re-establish the actuator rod bias towards the rest position.

* * * * *